US006317047B1

(12) United States Patent
Stein et al.

(10) Patent No.: US 6,317,047 B1
(45) Date of Patent: Nov. 13, 2001

(54) FIREFIGHTER'S SAFETY DEVICE

(76) Inventors: Michael Stein, 1769 West End Ave., New Hyde Park, NY (US) 11040; Patrick Maloney, 26 Jackson Pl., Massapequa, NY (US) 11758

( * ) Notice: Subject to any disclaimer, the term of this patent is extended or adjusted under 35 U.S.C. 154(b) by 0 days.

(21) Appl. No.: 09/561,543

(22) Filed: Apr. 28, 2000

(51) Int. Cl.[7] ..... G08B 23/00

(52) U.S. Cl. ..... 340/573.1; 340/298; 340/321; 340/326; 340/577

(58) Field of Search ..... 340/573.1, 321, 340/326, 577, 298

(56) References Cited

U.S. PATENT DOCUMENTS 4,468,656 * 8/1984 Clifford et al. ..... 340/539
5,042,613 * 8/1991 Hermann ..... 182/18
5,216,418 * 6/1993 Lenz et al. ..... 340/815
5,808,541 * 9/1998 Golden ..... 340/286.05
5,825,280 * 10/1998 Merendini et al. ..... 340/326
5,839,829 * 11/1998 Litvin et al. ..... 374/121
5,898,363 * 4/1999 Altilio ..... 340/384.1
6,144,309 * 11/2000 Fagence ..... 340/691.1

* cited by examiner

*Primary Examiner*—Jeffery Hofsass
*Assistant Examiner*—Son Tang
(74) *Attorney, Agent, or Firm*—Collard & Roe, PC.

(57) ABSTRACT

A fire fighter's safety device, comprising a hollow body having a sidewall, a top end and a bottom end and an arm connected to the body and extending parallel to the sidewall. There is a light source disposed at one of the top and bottom ends and an audible signal disposed within the body. There is a heat sensor connected to the body for sensing the temperature in the surrounding area, and a power source disposed with the hollow body and connected to the light source, audible signal and heat sensor. The device keeps a door open when the arm is inserted between a door and a door frame to rest on a door hinge and the audible signal and light indicate the exit during a fire.

11 Claims, 2 Drawing Sheets

FIREFIGHTER'S SAFETY DEVICE

BACKGROUND OF THE INVENTION

1. Field of the Invention

This invention relates to firefighter's safety device for use in burning buildings. In particular, the invention relates to a device that props a door open and indicates via light and sound the exit to a room during a fire.

2. The Prior Art

When fighting fires, it is often difficult to find one's way out of a room if the fire has generated a large amount of smoke. This is very dangerous to firefighters, who must exit burning buildings as quickly as possible when conditions become too dangerous to remain inside. In addition, doors through which the firefighters have entered a building may close, thus further obscuring the exit.

It is therefore desirable to provide a means for indicating the exit route during a fire. One device is shown in U.S. Pat. No. 5,042,613 to Hermann. This device comprises a means for attaching a cord to a doorway. The firefighter walks with the cord throughout the building. To exit, the firefighter follows the cord back to the doorway. There is also a light source on the device and a pager to alert other firefighters of danger. While this might be useful in some situations, it would be desirable to provide a way that indicates the exit to several firefighters at once, and which does not require the use of a cumbersome cord.

SUMMARY OF THE INVENTION

It is therefore an object of the invention to provide a safety device that indicates to the exit to anyone in the area.

It is another object of the invention to provide a safety device that keeps the door open for proper ventilation of the area.

It is yet another object of the invention to provide a safety device that indicates the temperature of the room and sounds an alarm if the temperature reaches a preset limit.

It is a further object of the invention to provide a safety device that records the time and date of activation and alarm soundings and relays the information to a remote location.

These and other objects of the invention are accomplished by a fire fighter's safety device comprising a hollow body having a sidewall, a top end and a bottom end and an arm connected to the top end and extending parallel to the sidewall. There is a light source disposed at one end and an audible signal disposed within the body. There is a heat sensor disposed at the top end for sensing the temperature in the surrounding area, and a power source such as a battery disposed with the hollow body and connected to the light source, audible signal and heat sensor. The device keeps a door open when the arm is inserted between a door and a door frame to rest on a door hinge. The audible signal and light indicate the exit during a fire. This is necessary especially when there is a lot of smoke in the room, because the exit can not easily be seen. In addition, it is important to keep the doors open to ventilate the rooms and to facilitate evacuation of the building.

There is a controller connected to the power source, light source, audible signal and heat sensor, for activating the light source, audible signal and heat sensor when the user presses a button on the device. The controller causes the audible signal to change when the heat sensor senses a temperature that exceeds a preset temperature, thus indicating a dangerous condition in the room. For example, the preset temperature could be set at 300° F.

The controller also records the time and date upon activation of the heat sensor, audible signal and light source. The controller also preferably records the time and date each time the heat sensor registers a temperature above a preset temperature. Controllers of this type are readily available and programmable to achieve this feature. There is a transmitter connected to the controller for transmitting the time and date recorded upon each activation to a remote receiver. This is a useful feature because it keeps track of the use of the device over a period of time, and allows fire fighters to track conditions in fires over time to further refine fire fighting procedures. The time and date information is preferably sent directly to a remote computer where the data can be tabulated and stored. The technology used to operate the controller, transmitter and receiver are well known in the art and are not discussed in detail here.

The light source is preferably a strobe light, which emits a bright pulsating light that can be seen through smoke. The audible signal is preferably a beeping noise that changes to a constant tone when the preset temperature is exceeded.

The heat sensor is preferably an infrared heat sensor that sends an infrared beam and measures the temperature of a surface hit by the beam. Generally, this will be the temperature of the ceiling at which the beam is aimed. The heat sensor can be any commercially available heat sensor. The heat sensor is preferably pivotally mounted, so that it can be aimed at the ceiling in either of the two rooms connected by the doorway. There is also a magnet attached to the sidewall for attaching the device to a metallic surface if no doorway is present.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
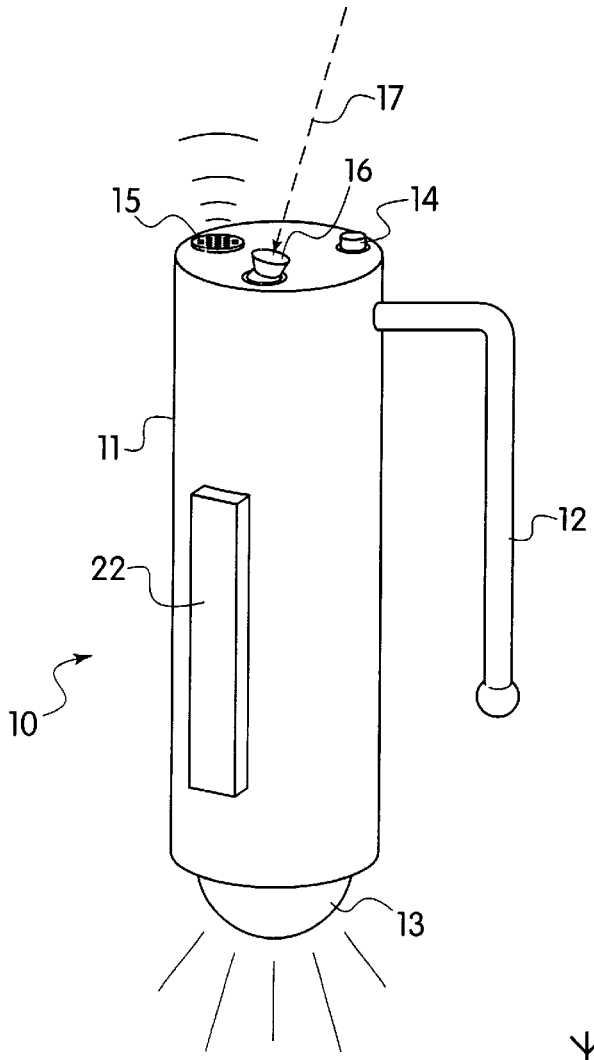
FIG. 1 shows a perspective view of the device according to the invention.

Referring now in detail to the drawings, FIG. 1 shows the device 10 according to the invention, which comprises a hollow body 11 having a side arm 12 extending therefrom. Body 11 can be made from PVC or from any other suitable material. Side arm 12 is preferably a strong metal, such as steel. There is a strobe light 13 arranged on the bottom of body 11, and an audible alarm 15, a pivotally mounted heat sensor 16, and a power button 14 for activating the components arranged on the top of body 11. Heat sensor 16 emits an IR beam 17 to measure the temperature of the surface hit by beam 17. Heat sensor 16 is pivotally mounted so that the target of beam 17 can be varied, for example, between two rooms when the device is mounted in a doorway. There is also a magnet 22 mounted on body 11 to secure device 10 to a metallic surface in case a doorway is not convenient or available. Other types of securing devices could also be used, such as an adhesive or a clamp.

Figure 2:
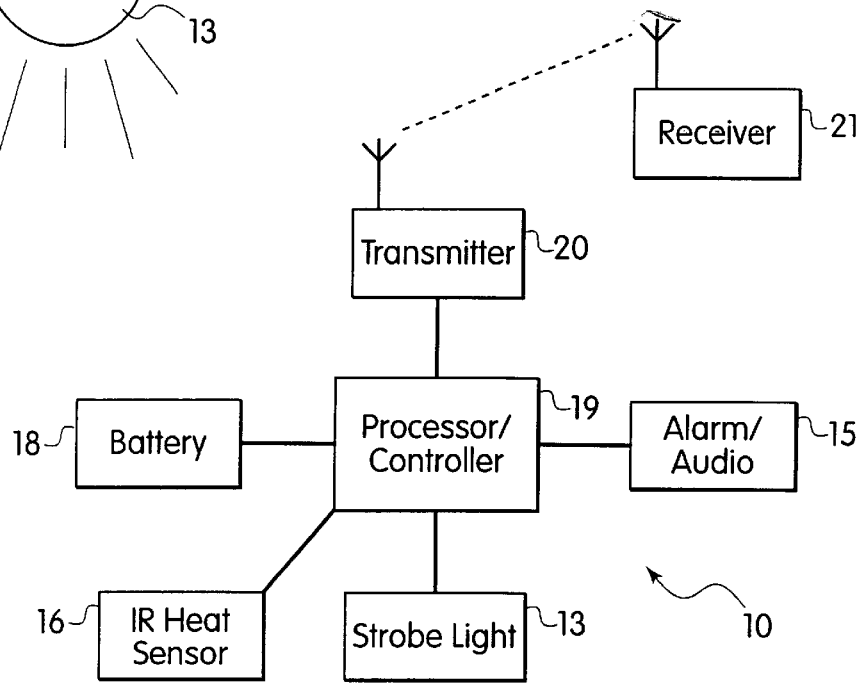
FIG. 2 shows a block diagram of the components of the device according to the invention.

The components of device 10 are shown schematically in FIG. 2. Strobe light 13, alarm 15 and heat sensor 16 are all connected to a controller 19 such as a microprocessor, which is powered by a battery 18. Connected to controller 19 is a transmitter 20, which transmits data from controller 19 to a remote receiver 21, where the data can be stored and tabulated. Controller 19 records the date and time each time the device is turned on, and also records the duration of each use. Controller 19 also records each time the heat sensor 16 senses a temperature above a preset temperature. Controller 19 also changes the tone of the audible alarm 15 when the preset temperature is reached, to warn occupants of the area of dangerous conditions.

Figure 3:
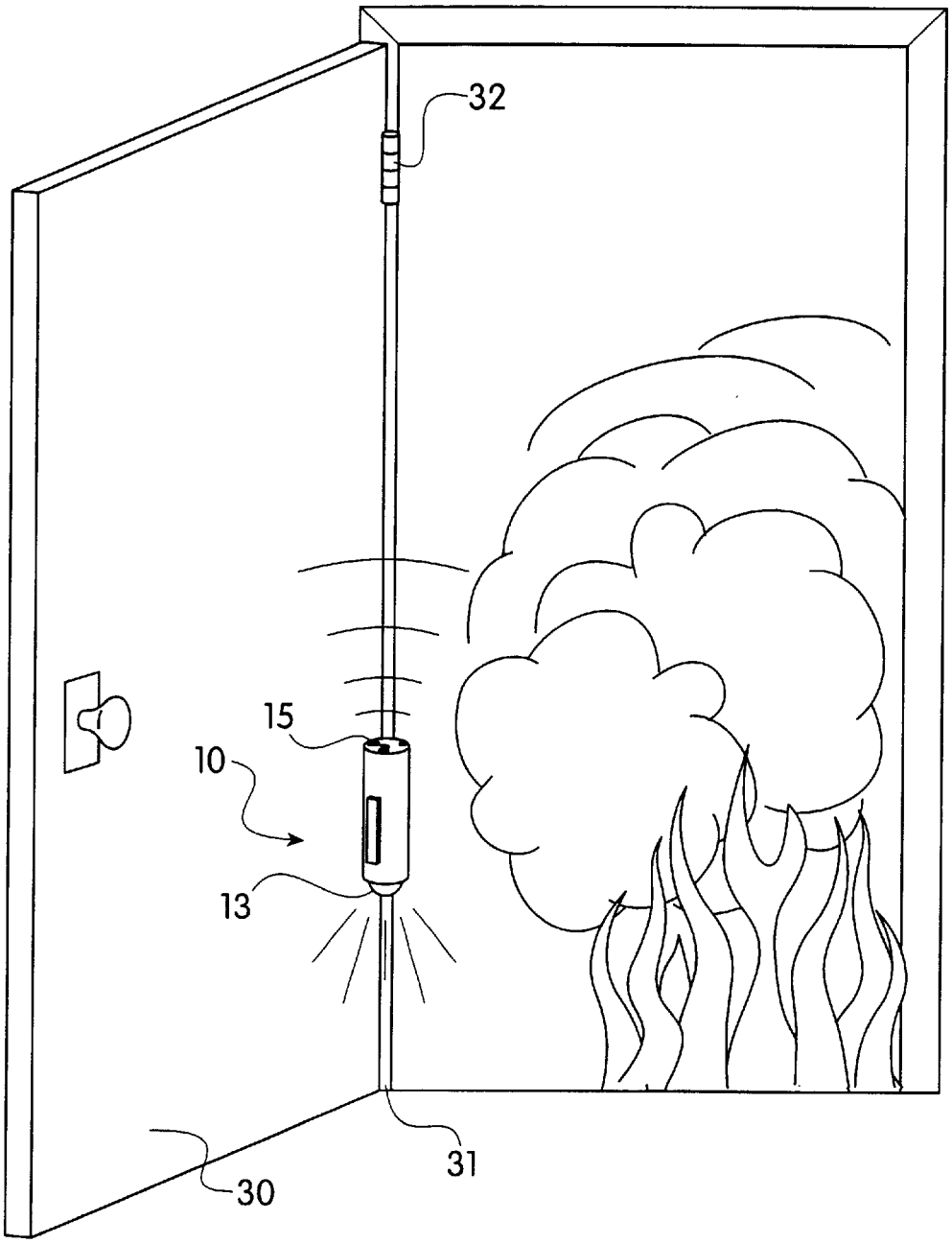
FIG. 3 shows the device in use mounted in a doorway.

FIG. 3 shows device 10 as it is mounted in between a door 30 and door frame 31. Arm 12 (not shown in FIG. 3) fits over and behind lower hinge 32 to hang device 10 over the hinge. Body 11 of device 10 keeps door 30 open, while light 13 and alarm 15 indicate the way to doorway 31 so that fire fighters can always find the exit when needed.

Accordingly, while only a single embodiment of the present invention has been shown and described, it is obvious that many changes and modifications may be made thereunto without departing from the spirit and scope of the invention.

What is claimed is:

1. A portable fire fighter's safety device, comprising:

a hollow body having a sidewall, a top end and a bottom end;

an arm connected to said hollow body and extending parallel to said sidewall;

a light source connected to said body;

an audible signal disposed within the body;

a heat sensor connected to said body, said heat sensor sensing the temperature in the surrounding area;

a power source disposed with said hollow body and connected to said light source, audible signal and heat sensor;

a controller connected to said power source, audible signal, light source and heat sensor and disposed within said hollow body, said controller activating said light source, audible signal and heat sensor and recording the time and date upon activation of the heat sensor, audible signal and light source; and a transmitter connected to said controller within said hollow body for transmitting the time and date recorded upon each activation to a remote receiver;

wherein said body keeps a door open when said arm is inserted between a door and a door frame to rest on a door hinge.

2. The device according to claim 1, wherein the controller causes the audible signal to change when said heat sensor senses a temperature that exceeds a preset temperature.

3. The device according to claim 2, wherein the audible signal is a beeping noise and wherein the audible signal changes to a constant tone when the preset temperature is exceeded.

4. The device according to claim 1, wherein the light source is a strobe light.

5. The device according to claim 1, wherein the heat sensor is an infrared heat sensor that sends an infrared beam and measures the temperature of a surface hit by the beam.

6. The device according to claim 5, wherein the heat sensor is pivotally mounted so that the beam can be aimed at a plurality of locations.

7. The device according to claim 1, further comprising a magnet attached to said sidewall for attaching said device to a metallic surface.

8. The device according to claim 1, wherein the controller records the time and date each time the heat sensor registers a temperature above a preset temperature.

9. The device according to claim 1, wherein the light source is disposed at the bottom end of said body.

10. The device according to claim 1, wherein the heat sensor and audible signal are disposed at the top end of said body.

11. The device according to claim 1, wherein the controller is a microprocessor.

* * * * *